United States Patent [19]

Tsukada

[11] Patent Number: 4,969,808

[45] Date of Patent: Nov. 13, 1990

[54] ELASTIC TUBING PUMP

[75] Inventor: Akira Tsukada, Tokyo, Japan

[73] Assignee: Oval Engineering Co., Ltd., Tokyo, Japan

[21] Appl. No.: 438,131

[22] Filed: Nov. 16, 1989

[30] Foreign Application Priority Data

Nov. 24, 1988 [JP] Japan ..... 63-153002[U]

[51] Int. Cl.[5] ..... F04B 43/12

[52] U.S. Cl. ..... 417/477; 417/476

[58] Field of Search ..... 417/474, 475, 476, 477; 604/153; 128/DIG. 12

[56] References Cited

U.S. PATENT DOCUMENTS

| | | | |
|---|---|---|---|
| 3,972,649 | 8/1976 | Jütte | 417/477 X |
| 4,380,236 | 4/1983 | Norton | 417/476 X |
| 4,445,826 | 5/1984 | Tarr | 417/476 |
| 4,906,168 | 3/1990 | Thompson | 417/477 |

*Primary Examiner*—Leonard E. Smith
*Assistant Examiner*—Eugene L. Szczecina, Jr.
*Attorney, Agent, or Firm*—Jordan & Hamburg

[57] ABSTRACT

The present invention relates to an elastic tubing pump and more particularly to an elastic tubing pump. The pump has an elastic tube communicating with a liquid supply source, a pressing means for pressing at least two points of a section of the elastic tube to seal the liquid therein, a driving means for pushing the pressing means in one direction of the elastic tube, a locking means for firmly holding the elastic tube from being moved by the pressing means, a shifting means for unlocking the locking means according to the driving operations of the driving means and for advancing the elastic tube by the length of its compressed section. The driving means can accelerate to compensate for the possible decrease in the liquid's flow through the tube during a time of shifting the elastic tube by one section's length.

1 Claim, 2 Drawing Sheets

ELASTIC TUBING PUMP

BACKGROUND OF THE INVENTION

The present invention relates to an elastic tubing pump and more particularly to an elastic tubing pump which is capable of shifting elastic tube by a certain specified length in order to change the position of the elastic tube to be squeezed by pressing rollers and thereby preventing the elastic tube from being worn under the repeated compressive stress.

An elastic tubing pump is a device that draws fluid into an elastic tube and delivers the same therethrough by successively compressing the tube in the direction of the delivery. The elastic tubing pump, by virtue of its ability to transfer any fluid, mainly liquid, and not to destroy living cells has been more and more widely used in medical treatment as for example in the artificial purification of blood through dialysis and also in the fields of biotechnology. However, since in the usual device, repeated compression is applied to the same portion of the elastic tube over a period of time, the tube may easily be prematurely worn and unuseable over a long period of time. Consequently, it has been necessary to replace the elastic tube with new one after a specified time of pumping operation.

In order to solve the above-mentioned problem, the present applicant has previously proposed, based upon the fact that the elastic tube being used as clamped in place and not moveable in the pumping direction, to unclamp the elastic tube after a certain time has elapsed to allow the tube to move past the length of its fatigued portion and then to be compressed at a new unused portion.

The above-mentioned elastic tubing pump is able to move the elastic tube for periodically changing its used portion for a new portion by which the decrease in the reliability of the pump may be restored and, furthermore, the elastic tube can be used continuously over its full length. Accordingly, the cost of the elastic tubing pump may be kept low. There remains the problem that, when the tube is released from the clamper and shifted, the relative moving speeds of the elastic tube and rollers are decreased and therefore the rate of flow may be decreased and become incorrect.

SUMMARY OF THE INVENTION

It is an object of the present invention to solve the above-mentioned problems of the prior art, that is, to keep the flow of the fluid in the elastic tube constant by substantially eliminating a change in the relative moving speeds of the rollers and the elastic tube.

It is another object of the present invention to provide a highly reliable and accurate elastic tubing pump wherein after a preset duration of operation the partially fatigued elastic tube may be shifted to present its new portion to work and thus it may be used continuously over its full length and, furthermore, in the course of shifting the elastic tube the possible decrease of liquid delivery can be previously compensated.

It is another object of the present invention to provide an elastic tubing pump comprising elastic tube communicating with a liquid supply source, a pressing means for pressing at least two points of a section of said elastic tube to seal the liquid therein, a driving means for urging said pressing means in one direction at said elastic tube section, a locking means for firmly holding the elastic tube from being moved by the pressing means, a shifting means for unlocking said locking means according to the driving operations of the driving means and advancing the elastic tube by the length of its compressed section, characterized in that during a time of shifting the elastic tube by one section's length the driving means can accelerate to compensate for the possible decrease of the liquid's flow through the tube.

DESCRIPTION OF THE PREFERRED EMBODIMENTS

Figure 1:
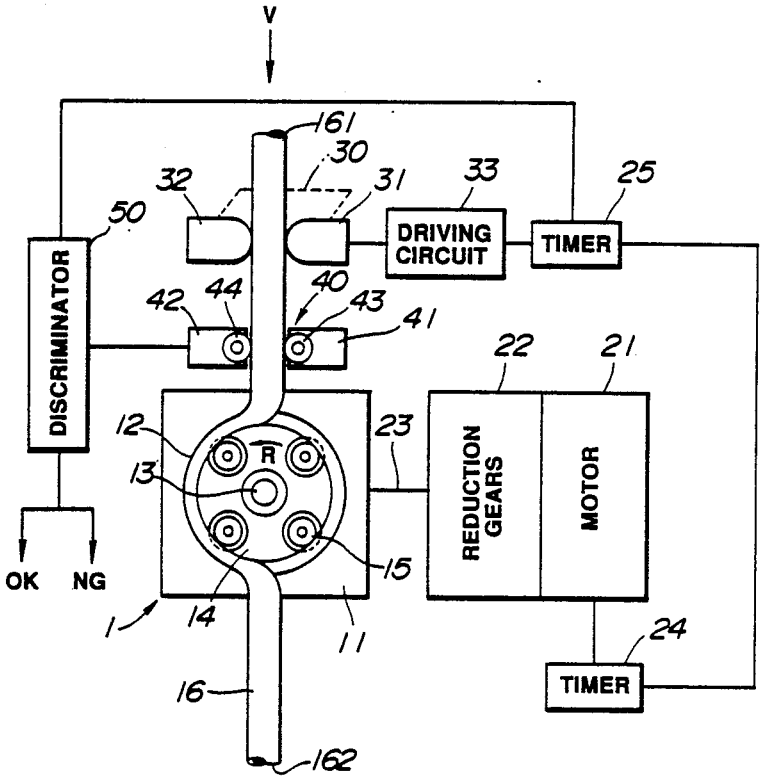
FIG.1 (PRIOR ART)
FIG. 1 is a view showing a prior art.

FIG. 1 is a block diagram for explaining an example of the above-mentioned elastic tubing pump proposed by the present applicant. In FIG. 1, an elastic tubing pump 1 comprises a body 11 having a round groove 12 slotted therein, a cylindrical element 14 rotatably mounted on a rotary shaft 13 disposed concentrically with the groove 12 and a plurality of rollers 15 of the same form and the same size which are arranged at the periphery of the cylindrical element 14 and which revolve around it. An elastic tube 16 is inserted through a passage between the rollers 15 and the groove 12. The rotary shaft 13 is rotated by a motor 21 through reduction gears 22 by which it is coupled with a driving shaft 23. When the cylindrical element 14 rotates in the direction shown by the arrow R, liquid in the elastic tube communicating with a liquid supply source (not shown) is delivered under pressure from the supply side 161 to the delivery side 162. At this time, friction between the elastic tube 16 and the roller 15 brings about a force acting on the elastic tube in the direction of the rotation and consequently the elastic tube 16 moves in the direction shown by the arrow V, thereby overcoming the force of the friction with the pressure of the groove. A clamper 30, as is well known, can firmly hold the elastic tube between the clamp's sections 31 and 32 so as to prevent the elastic tube from moving. A movement detector 40 is provided between the clamper 30 and the elastic tubing pump 1. The elastic tube is movably held between rollers 43 and 44 of said movement detector 40. The movement of the elastic tube 16 is detected by the rotation of the detecting rollers 43 and 44. A first timer 24 is set to a specified period from the time of putting the motor 21 into operation.

The time when the compressed portion of the elastic tube may begin to be used as for instance after 500 hours, is selected by the first timer 24. A second timer 25 is set to a time $\Delta T$ when the elastic tube is released from the clamper 30 at the same preset time as the first timer 24 and moves while its new portion is set in the groove 12. A driving circuit 33 is used for feeding a current to the coil of the clamper 30 for the time of $\Delta T$. According to the detection signal of the movement detector 40, a discriminator 50 senses that the elastic tube 16 has moved by a certain length within an allowable range for the time of $\Delta T$ while the clamper is being kept open. When the distance of the movement of the elastic tube is within the allowable limits, the "OK" lamp of the discriminator lights up. If not, the "NG" lamp lights up.

The above-mentioned elastic tubing pump is able to move the elastic tube for periodically changing its used portion for a new portion by which the decrease in the reliability of the pump may be restored and, furthermore, the elastic tube can be used continuously over its full length. Accordingly, the cost of the elastic tubing pump may be kept low. There remains the problem that, when the tube is released from the clamper and shifted, the relative moving speeds of the rollers 15 and the elastic tube 16 are decreased and therefore the rate of flow may be decreased and become incorrect.

Figure 2:
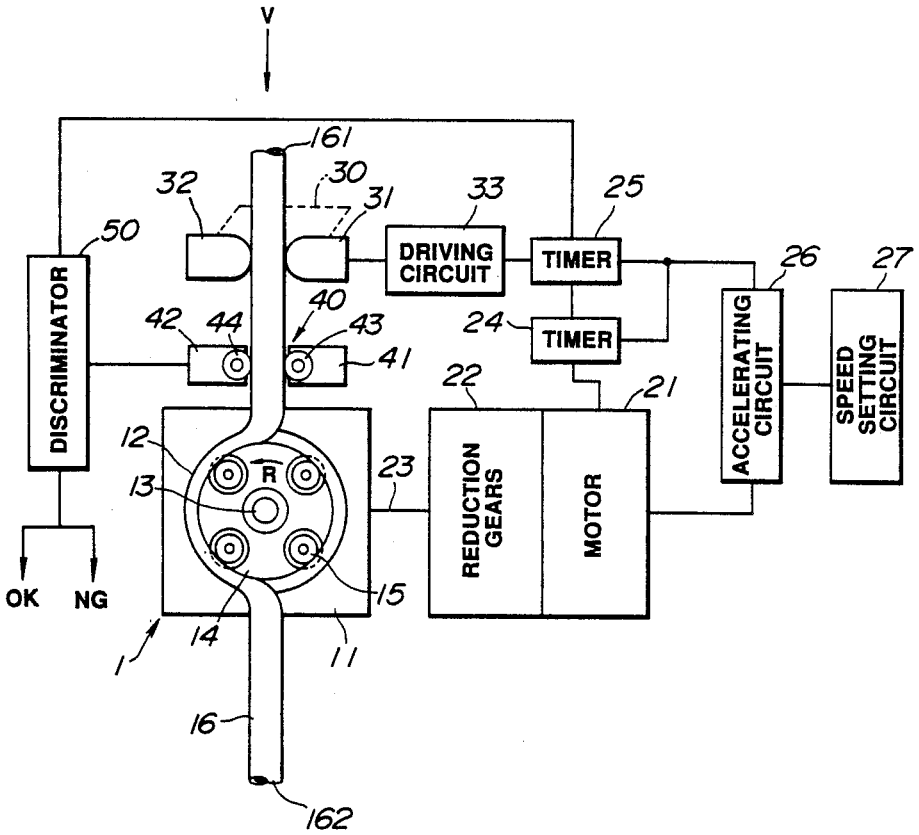
FIG. 2 is a schematic block diagram showing an elastic tube pump according to the present invention.

FIG. 2 is a view showing an embodiment of the present invention. However, it includes components similar to the prior art previously described with reference to FIG. 1, wherein liquid can be pumped through elastic tube 16, inserted through a pump 1 and clamped by a clamper 30 when rollers 15 are driven into rotation by a motor 21 and press the elastic tube; when an operating time preset by a first timer 1 has elapsed, the clamper 30 is opened for the time preset by a second timer 25 to allow the elastic tube to be advanced by the length corresponding to the length of a groove 12 in the pump body 1. According, in FIG. 2, elements similar to those shown in FIG. 1 are given like reference numerals and are omitted from further description. In FIG. 2, numeral 26 designates a circuit for accelerating a motor 21. If the motor 21 is a DC unit, the circuit increases the driving voltage of the motor. If the motor is an AC unit, the circuit increases the driving frequency of the unit. Both cases are well known. The acceleration ratio of the accelerating circuit is determined by the rotation speed setting circuit 27.

The operation of the elastic tubing pump will now be explained. Delivery of the elastic tubing pump 1 is calculated by multiplying the volume of the liquid sealed in the section of the elastic tube 16 between two neighboring rollers 15 by the pressing speed of said rollers. While the liquid is being delivered, there is a force, between the pressing rollers 15 and the elastic tube acting in the direction of the insertion to always push the elastic tube forward. However, the elastic tube moves at a lower speed than the pressing speed due to the force of the friction between the groove 12 and the elastic tube. Accordingly, the moving speed of the elastic tube varies depending upon the value of the force of the friction between the elastic tube and the groove. It has been confirmed that at a constant friction value the moving speed of the elastic tube becomes constant with a decrease of 5 to 10% in delivery. The speed-setting circuit 27 is adjusted to the value necessary for compensating for the decrease of the pump's delivery. Thus the elastic tubing pump can maintain a constant delivery of liquid both in a fixed condition and in a moving condition.

As is apparent from the foregoing description, according to the present invention, it is possible to provide a highly reliable and accurate elastic tubing pump wherein after a preset duration of operation the partially fatigued elastic tube may be shifted to present its new portion to work and thus it may be used continuously over its full length and, furthermore, in the course of shifting the elastic tube the possible decrease of liquid delivery can be previously compensated.

What is claimed is:

1. An elastic tubing pump comprising an elastic tube communicating with a liquid supply source, a pressing means for pressing at least two points of a section of said elastic tube to seal the liquid therein, a driving means for pushing said pressing means in one direction of said elastic tube, a locking means for firmly holding the elastic tube from being moved by the pressing means, a shifting means for unlocking said locking means according to the driving operations of the driving means and for advancing the elastic tube by the length of its compressed section, characterized in that during a time of shifting the elastic tube by one section's length, the driving means can accelerate to compensate for the possible decrease in the liquid's flow through the tube.

* * * * *